United States Patent [19]

Ritland et al.

[11] 4,106,559

[45] Aug. 15, 1978

[54] TUBE SIDE FLOW CONTROL DEVICE FOR MOISTURE SEPARATOR REHEATERS

[75] Inventors: Paul D. Ritland, Upper Darby Township, Delaware County; Thomas J. Rabas, Broomall, both of Pa.

[73] Assignee: Westinghouse Electric Corp., Pittsburgh, Pa.

[21] Appl. No.: 755,385

[22] Filed: Dec. 29, 1976

[51] Int. Cl.[2] ..... F28B 9/02; F28B 9/08; F28B 11/00; F28F 9/02

[52] U.S. Cl. ..... 165/111; 122/483; 137/171; 138/40; 165/158; 165/176

[58] Field of Search ..... 122/483, 488; 165/110, 165/111, 112, 174, 176, 158; 137/171; 138/39, 40

[56] References Cited

U.S. PATENT DOCUMENTS

| | | | |
|---|---|---|---|
| 2,098,671 | 11/1937 | Paget | 165/110 |
| 2,111,991 | 3/1938 | Richard | 138/40 |
| 2,589,733 | 3/1952 | Rosenblad | 165/111 |
| 3,604,502 | 9/1971 | Morse et al. | 165/110 |
| 3,759,319 | 9/1973 | Ritland et al. | 165/111 |

FOREIGN PATENT DOCUMENTS

| | | | |
|---|---|---|---|
| 2,247,691 | 5/1975 | France | 122/483 |
| 10,770 | 4/1908 | Denmark | 165/158 |

*Primary Examiner*—Charles J. Myhre
*Assistant Examiner*—Sheldon Richter
*Attorney, Agent, or Firm*—J. W. Keen

[57] ABSTRACT

A control device regulating flow rate of a two-phase mixture of steam and water through a vent conduit in fluid communication with the exit from the fourth pass of a four-pass heat exchanger and a low pressure source. The heat exchanger conducts a first fluid vapor through the first and second tube side passes while condensing a portion of the first fluid vapor therein and separating the resulting mixture into condensate and vapor portions at the exit of the second pass. The separated first fluid vapor is then routed through the third and fourth passes where additional condensation of first fluid vapor takes place. A high ratio of first fluid vapor to first fluid condensate is maintained in all four passes to prevent tube failure due to cyclic tube temperatures resulting from alternate flooding and draining of the tubes' interior. The first fluid exiting from the fourth pass is a two-phase mixture of vapor and condensate which must both be vented to a lower pressure source. A control section of conduit of appropriate size is disposed in the vent line to regulate the mixture's flow therethrough and the corresponding first fluid velocity through the four passes of the heat exchanger.

8 Claims, 3 Drawing Figures

TUBE SIDE FLOW CONTROL DEVICE FOR MOISTURE SEPARATOR REHEATERS

BACKGROUND OF THE INVENTION

This invention relates to moisture separator reheaters having a scavenging steam vent condenser, and more particularly to flow control devices for regulating vent flow rates while passing a two-phase mixture therethrough at a predetermined flow rate.

A scavenging steam vent condenser was developed to alleviate tube failure problems which were the result of cyclic tube temperatures caused by alternate flooding and draining of the tubes of moisture separator reheaters. A better operational understanding of a moisture separator reheater equipped with a scavenging steam vent condenser can be obtained by referencing R. L. Coit's copending patent application assigned to the assignee of the present invention and whose serial number, filing date, and title are respectively Ser. No. 650,836, Jan. 21, 1976, and "Apparatus For Increasing Effective scavenging Steam Within A Heat Exchanger Which Condenses Vapor Inside Long Tubes". The introduction of the scavenging steam vent condensers in moisture separator reheaters provided two additional passes therethrough, but created a problem which was non-existent in previous two-pass moisture separator reheater designs. That problem was the conveying away in a controlled fashion of the vapor and condensate which exit from the fourth pass of the moisture separator reheater. Before scavenging steam vent condensers were designed, separation of condensate and vapor exiting from the second pass was feasible in that the tube side flow chamber was divided into an inlet and an outlet portion with the outlet portion providing a sufficiently large plenum for separating the condensate from the remaining vapor. However, by converting moisture separator reheaters to four-pass heat exchangers, the available plenum size within the chamber at the exit from the fourth pass was only marginally sufficient to accomplish separation between the vapor and liquid phases. Separation of the two phases was desirable to allow predictable regulation of the vapor's flow rate being vented to a lower pressure source. The separated liquid and vapor portions would then each be controllable by standard, single-phase flow regulating devices.

Phase separation of the fluid exiting the fourth pass necessitated the use of an additional separation tank, a vapor conduit, and a condensate conduit. The separation tank had to be located on the exterior of the moisture separator reheater because the available volume within the chamber was of insufficient size to permit phase separation. The additional condensate conduit was required because condensate exiting the fourth pass was at a lower pressure than the vapor and condensate exiting from the second pass. This pressure difference would have caused much of the second pass's exiting vapor and condensate to "short circuit" the third and fourth passes and thereby promote inefficient operation of those passes.

It was determined that the most reliable and economically feasible means for venting the fluid exiting from the fourth pass of the moisture separator reheater was a single conduit line passing from a fourth pass exit manifold to a lower pressure source. However, to prevent increases in heat rate as a result of excessive venting and to avoid temperature cycling of the tube wall which can result in failure of the tubes and their surrounding welds, a highly reliable and predictable means for controlling the fluid flow rate through the third and fourth passes was required. It was discovered that much investigation during the 1960's was devoted to flashing, critical flow of saturated water because of concern for a major accident in the coolant system of nuclear reactor power plants. In particular, Fauske's paper entitled "The Discharge of Saturated Water Through Tubes" was extensively referenced in the development of this invention.

SUMMARY OF THE INVENTION

In general, a heat exchanger made in accordance with this invention comprises in combination a shell, a tube sheet having a plurality of holes, a plurality of tubes arranged inside the shell and having at least one end thereof disposed in the tube sheet holes, a chamber cooperatively associated with the tube sheet and shell, a dividing plate for separating the chamber into an inlet and an outlet portion, an inlet opening in the chamber used for allowing fluid flow therethrough to the inlet portion, a manifold situated within the chamber and in fluid communication with a plurality of the tubes in such manner as to cause a portion of the fluid to make four passes through the tubes, an outlet opening in the chamber for providing fluid communication for the fluid from the outlet portion, a vent line providing fluid communication from the exit of the fourth pass tubes to a lower pressure source, and a means for controlling the flow rate of a two-phase mixture through the vent line whereby alternate flooding and draining of the tubes' interior is avoided and non-condensable substances are removed from the heat exchanger. A conduit was arranged in the vent line in close proximity to the low pressure source with the conduit having a ratio of flow length to equivalent flow diameter of at least 12 which will yield both a critical, controlling flow rate while maintaining thermodynamic equilibrium therethrough. Maintaining thermoequilibrium allows existing flow rate correlations to be used for various flow conditions. As a result of this two-phase flow control device, the vent flow rate and the tube side flow rate through the heat exchanger can be more precisely regulated causing improvement in overall plant heat rate and decreasing the thermal cycling of the heat exchanger tubes which can result in a reduced tube failure frequency.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENT

Figure 1:
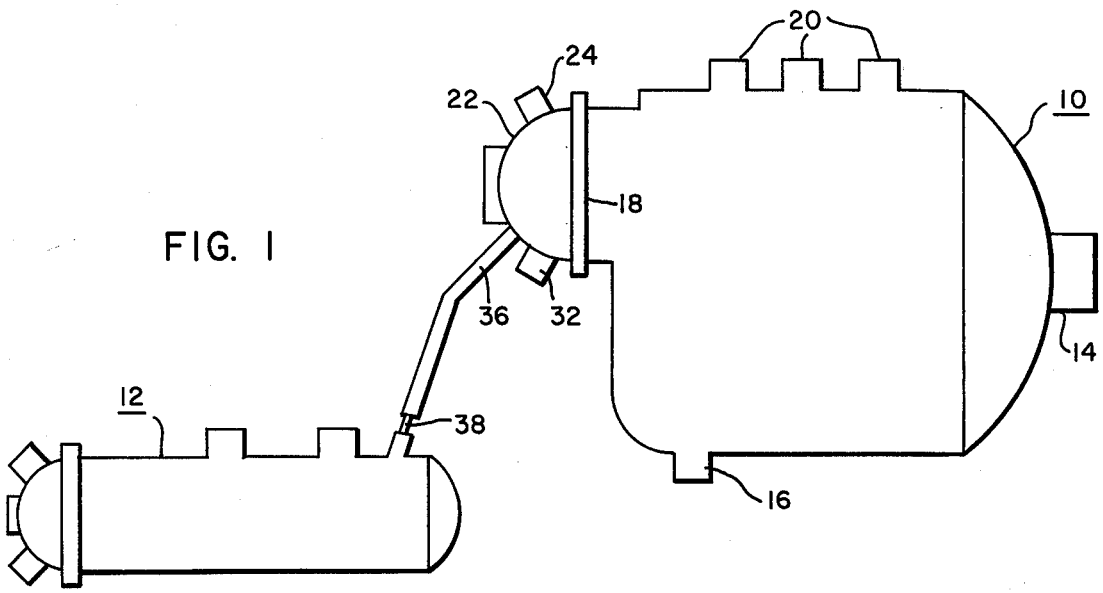
FIG. 1 is an elevation view of a moisture separator reheater having its tube side flow vented to a feedwater heater through a conduit which has a flow rate control section.

Referring now to the drawings in detail, FIG. 1 shows an elevation view of a moisture separator reheater 10 having a portion of its tube side fluid flow vented to a lower pressure source such as feedwater heater 12. Moisture separator reheater 10 receives wet stream through nozzle 14, removes much of the moisture from the wet stream, passes the moisture out through drain nozzle 16, and reheats the steam remaining after the separation process by passing it in a cross-flow manner across a plurality of tubes whose ends protrude through and are firmly attached to tube plate 18. After being heated, the steam passes out of moisture separator reheater 10 through steam outlet nozzles 20.

Figure 2:
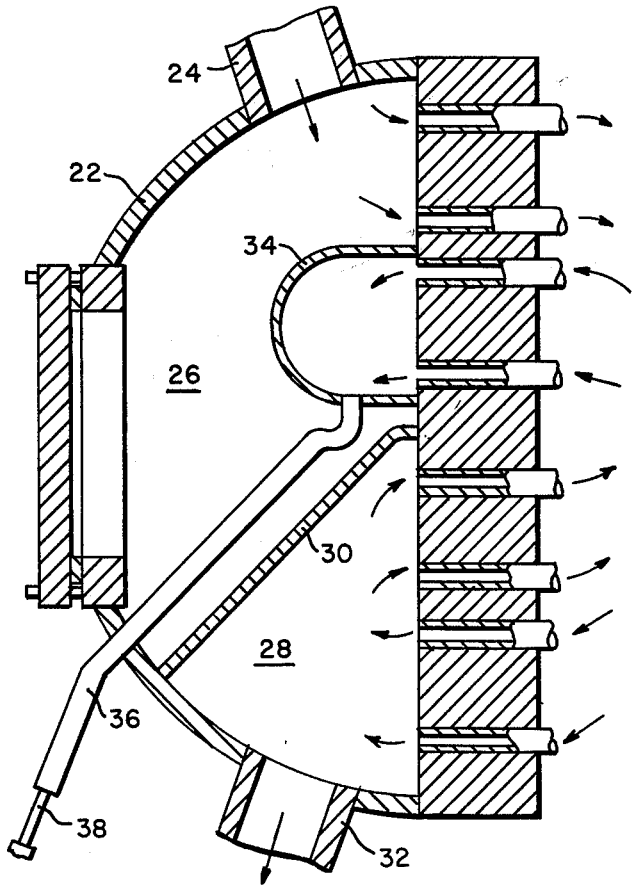
FIG. 2 is a sectional view of the tube side inlet chamber and attached tube plate for the moisture separator reheater illustrated in FIG. 1.

Heating steam enters the chamber 22 by flowing through inlet nozzle 24. Chamber 22 is separated into an inlet portion 26 and an outlet portion 28 by dividing plate 30 which is better illustrated in FIG. 2. The heating steam flows into tubes disposed at the outer periphery of the tube bundle with a portion of it being condensed on the interior of the tubes while passing therethrough and exiting into the outlet portion 28 of chamber 22. The condensate is then separated from the remaining vapor and is conducted out of chamber 22 through outlet nozzle 32 while the vapor enters a second group of tubes located near the tube bundle's center. The vapor then travels through the third and fourth passes with a portion of it being condensed before exiting from the fourth pass and passing into vent manifold 34. Arrows indicate the path followed by the heating steam and resulting condensate.

Manifold 34 isolates the two-phase mixture exiting the fourth pass from the dry steam entering the first pass but, cannot supply a volume adequate in size to separate the exiting condensate from the exiting vapor. A single vent line 36 permits transmission therethrough of the two-phase mixture causing the tube side of moisture separator reheater 10 to be relieved of non-condensables accumulated therein and also prevents slugs of condensate from flooding portions of the tubes'interior.

To regulate the two-phase flow rate through vent line 36, an unconventional flow restrictor must be used. Nozzles and orifice plates function satisfactorily for single-phase flow therethrough but, result in metastable flow states when used for regulating the flow of two-phase mixtures. Consequently, conduit 38 is utilized to develop critical flow therethrough and also maintain thermodynamic equilibrium so that existing flow correlations therethrough may be utilized. The dimensional parameters of control conduit 38 may be varied according to the flow passing therethrough and the size of the vent line 36 attached to it. While it is necessary that vent line 36 develop subcritical flow therethrough, control conduit 38 will generally function satisfactorily when its ratio of flow lengths to flow diameter is at least 12. By using control conduit 38, a single vent line 36 can be utilized to transmit the resulting two-phase flow rather than establishing an additional, large plenum exterior to chamber 22 where separation of the two phases may be accomplished.

During startup, it may be necessary to vent manifold 34 to a condenser through a similar vent line 36 and control conduit 38 to provide the required, driving pressure drop for the heating steam. As shown in FIG. 1, the control conduit 38 is attached to feedwater heater 12 in order to avoid downstream erosion of vent line 36. The erosion would be caused by the two-phase flow flashing after it passed through control conduit 38. The eroding effect, however, is minimized in the feedwater heater 12 or other low pressure source by providing impingement plates (not shown) or other suitable shielding devices to protect sensitive materials and erodable surfaces. The two-phase flow rate through control conduit 38 must be closely regulated in order to maximize total power plant efficiency and minimize potential tube failures in the moisture separator reheater.

Figure 3:
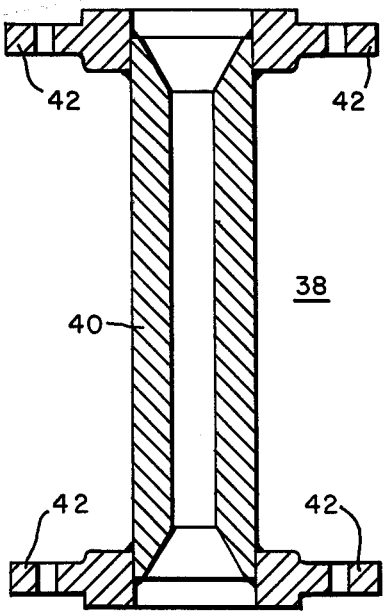
FIG. 3 is a sectional view of a two-phase flow control device used in FIG. 1.

FIG. 3 illustrates a sectional view of control conduit 38. Pipe 40 of suitable inside diameter for the desired flow rate has each end secured to an appropriate bolted flange 42.

A converging opening is formed on both ends of pipe 40 with the smaller end of each converging opening defining the extreme ends of pipe 40's normal inside diameter. Bolted flange 42 is provided for easy removal and replacement of control conduit 38. Pipe 40 and flange 42 are made from erosion and corrosion resistant material such as stainless steel to prevent rapid wearing of the control conduit under the severe environment to which it is exposed.

It will be apparent that an improved venting scheme for moisture separator reheaters equipped with scavenging steam vent condensers has been provided in which two-phase flow is transmitted and whose flow rate is regulated by a control conduit 38 which is assembled in vent line 36 and which simplifies the venting scheme and provides greater moisture separator reheater reliability.

We claim as our invention:

1. A heat exchanger for transferring heat from a first fluid to a second fluid with the first fluid changing phase from a vapor to a liquid, said heat exchanger comprising:

a shell;

a tube sheet having a plurality of holes therethrough;

a plurality of tubes arranged in said shell so as to be exposable to said second fluid, said tubes having at least one end thereof disposed in said tube sheet holes;

a chamber cooperatively associated with said shell and tube sheet;

a dividing means for separating said chamber into an inlet and an outlet portion;

an inlet opening in said chamber for providing fluid communication for said first fluid to said inlet portion;

a manifold being disposed in said chamber so as to be in fluid communication with a plurality of said tubes causing a portion of said first fluid vapor to make four passes through said tubes;

an outlet opening in said chamber for providing fluid communication for said first fluid from said outlet portion, said outlet opening being disposed in said chamber between said second and third passes where a plenum is disposed which can separate the first fluid liquid condensed in said first and second passes from said first fluid vapor prior to said first fluid vapor entering said third pass;

a vent line providing fluid communication from the exit of said fourth pass tubes to a lower pressure source, said vent line exclusively transmitting all fluid exiting said fourth pass, said fluid constituting a two phase mixture of vapor and liquid; and said vent line being disposed to vent a two-phase mixture of vapor and liquid therethrough; and a means for predictably controlling the flow rate of said two-phase mixture through said vent line whereby said first fluid vapor remaining after passing through said first and second passes is drawn through said third and fourth passes where a part of it is condensed into a liquid.

2. The heat exchanger of claim 1, wherein said tubes are U-shaped and have both ends disposed in said tube sheet holes.

3. The heat exchanger of claim 1, wherein the ratio vented first fluid vapor mass flow rate to first fluid vapor mass flow rate entering said inlet opening is minimized so as to be not greater than 0.02.

4. The heat exchanger of claim 1, wherein said controlling means are situated in such manner as to minimize said vent line's length between said controlling means and said lower pressure source.

5. The heat exchanger of claim 1, wherein said controlling means are erosion and corrosion resistant.

6. The heat exchanger of claim wherein said controlling means constitutes said vent line having critical flow therethrough and a minimum ratio of flow length to equivalent hydraulic flow diameter of 12.

7. The heat exchanger of claim 1, said controlling means comprising:

a conduit in fluid communication with said vent line where said conduit causes critical flow therethrough and has a minimum ratio of flow length to equivalent hydraulic flow diameter of 12.

8. The heat exchanger of claim 7, wherein said vent line causes subcritical flow therethrough.

* * * * *